US006666523B2

(12) United States Patent
Hogg

(10) Patent No.: US 6,666,523 B2
(45) Date of Patent: Dec. 23, 2003

(54) REEF MINER WITH DISK AND DRUM CUTTERS

(75) Inventor: William Hogg, Wishaw (GB)

(73) Assignee: DBT GB Limited, Lanarkshire (GB)

( * ) Notice: Subject to any disclaimer, the term of this patent is extended or adjusted under 35 U.S.C. 154(b) by 67 days.

(21) Appl. No.: 10/010,623

(22) Filed: Dec. 7, 2001

(65) Prior Publication Data

US 2002/0117887 A1 Aug. 29, 2002

(30) Foreign Application Priority Data

Dec. 7, 2000 (GB) ..... 0029844

(51) Int. Cl.[7] ..... E21C 25/52
(52) U.S. Cl. ..... 299/53; 299/42; 299/71
(58) Field of Search ..... 299/42, 51, 52, 299/53, 54, 71

(56) References Cited

U.S. PATENT DOCUMENTS

| | | | | | |
|---|---|---|---|---|---|
| 3,907,367 A | * | 9/1975 | Nakajima | ..... | 299/53 |
| 4,189,183 A | * | 2/1980 | Borowski | ..... | 299/1.6 |
| 4,273,383 A | * | 6/1981 | Grisebach | ..... | 299/53 |
| 4,465,320 A | * | 8/1984 | Schupphaus | ..... | 299/81.3 |
| 4,749,194 A | | 6/1988 | Schmid | ..... | 299/71 |

FOREIGN PATENT DOCUMENTS

| | | | | |
|---|---|---|---|---|
| GB | 1393443 | 5/1975 | ..... | E21C/27/24 |
| GB | 2 096 206 | 10/1982 | ..... | E21C/27/20 |
| WO | WO 86/02697 | 5/1986 | ..... | E21D/9/10 |

* cited by examiner

*Primary Examiner*—Heather Shackelford
*Assistant Examiner*—John Kreck
(74) *Attorney, Agent, or Firm*—Heslin Rothenberg Farley & Mesiti P.C.

(57) ABSTRACT

A mining machine is employed in a mechanized method for removing mineral from a reef in a rock face. The mining machine comprises a first cutting disc rotatably mounted on one side, a second cutting disc rotatably mounted on the machine, at a position off-set from the first disc and a cutting drum The first disc is adapted to remove a portion of the rock face as the machine is traversed along the face; and said drum is mounted upon an arm which is vertically repositionable to allow the cutting drum to remove rock from the roof and floor of the trench formed by the action of the cutting discs.

9 Claims, 4 Drawing Sheets

REEF MINER WITH DISK AND DRUM CUTTERS

This invention relates to a mining apparatus and method and, more particularly, to an apparatus for mining reef bearing mineral such as platinum and gold and to a mechanised method for the removal thereof.

Hard rock mining techniques currently in use require a substantial labour force and often involve blasting of the rock face in order to expose the reef to allow the work force to then recover the mineral from the reef. Once the reef has been exposed, the mineral may for example be removed by further drilling and blasting, or an impact ripping operation which involves a hydraulically operated hammer which is applied manually to the face in order to break the rock which is then loaded onto a reciprocating conveyor which removes the rock from the face to a remote location for further processing.

Such operations are expensive, time and labour intensive. This leads to instances where ore may not be mined due to concerns as to the economic viability of the operation.

It is an object of the present invention to provide a mining system which can remove the reef both effectively and efficiently from such locations in order to make such operations economically feasible.

It is a further object of the present invention to provide a mining system and a method of mining that allows a greater recovery rate of mineral from a reef than is currently available. This is especially desirably in the mining of mineral from relatively small reefs such as around 800 mm in height.

According to one aspect of the present invention there is provided a mining machine for removing a reef of mineral from a rock face, the mining machine comprising a first cutting disc rotatably mounted on one side thereof, which disc is adapted to remove a portion of the rock face as the machine is traversed along the face; a second cutting disc rotatably mounted on the machine, at a position off-set from the first disc, and a cutting drum, said drum being mounted upon an arm which is vertically repositionable to allow the cutting drum to remove rock from the roof and floor of the trench formed by the action of the cutting discs.

An advantage of the above mining machine is that as the cutting discs remove the center portion of the seam of ore, the cutting drum follows and trims the remaining reef thereby creating a smooth roof and floor on which to allow the full system to advance freely.

Furthermore, as the position of the arm upon which the cutter drum is mounted can be adjusted vertically, the path of the drum can be altered to follow the contours of the reef and thereby recover additional material which cannot be recovered through use of an apparatus provided with the cutting discs alone.

Preferably the system further comprises a conveyor for the purpose of carrying the machine and a means for removing material from the rock face more advantageously a flexible conveyor.

Preferably also, the cutter drum comprises means to direct material cut from the face onto the conveyor means, thereby allowing the machine to be operated by a sole operator Advantageously, means are provided for advancing the mining machine towards the rock face at the end of each pass along the face.

According to a further aspect of the present invention there is provided a mechanised method of removing mineral from a reef in a rock face, for example, using the system of the first aspect, which method comprises the steps of applying a cutting machine to the rock face, the cutting machine having a plurality of off-set cutting discs which remove the center part of the reef to form a channel, and applying a further cutting drum to the roof and floor of the channel which is cut into the mineral bearing reef to allow the system to advance freely. The further cutting drum may create a smooth roof and floor on which to allow the system to advance freely.

One embodiment of the invention will now be described with reference to and as shown in the accompanying drawings in which.

Figure 1:
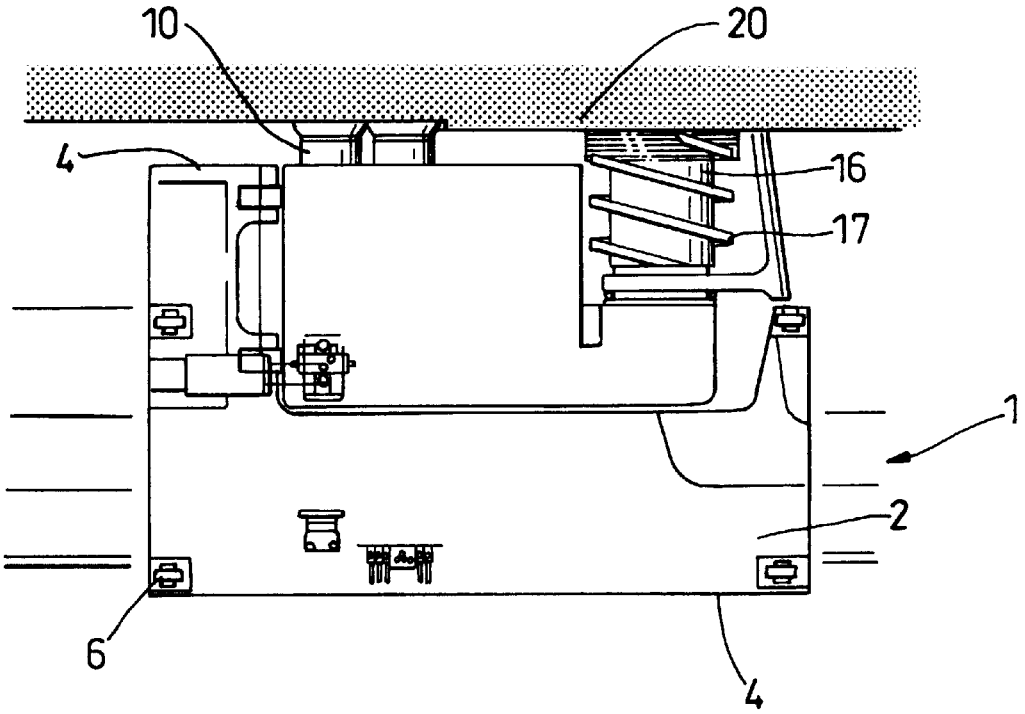
FIG. 1 is a plan view of a mining machine according to one aspect of the present invention.
Figure 3:
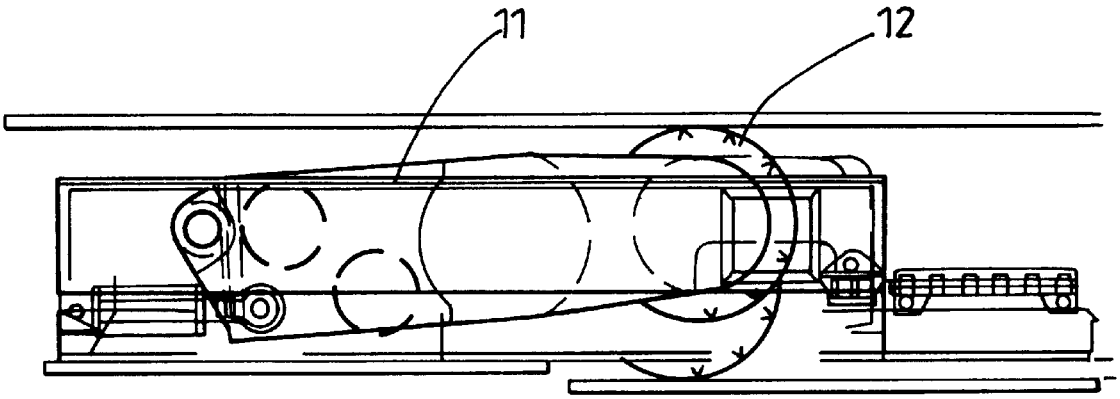
FIG. 3 is a side elevation view of the mining machine of FIG. 1 showing the arm in different positions.
Figure 2:
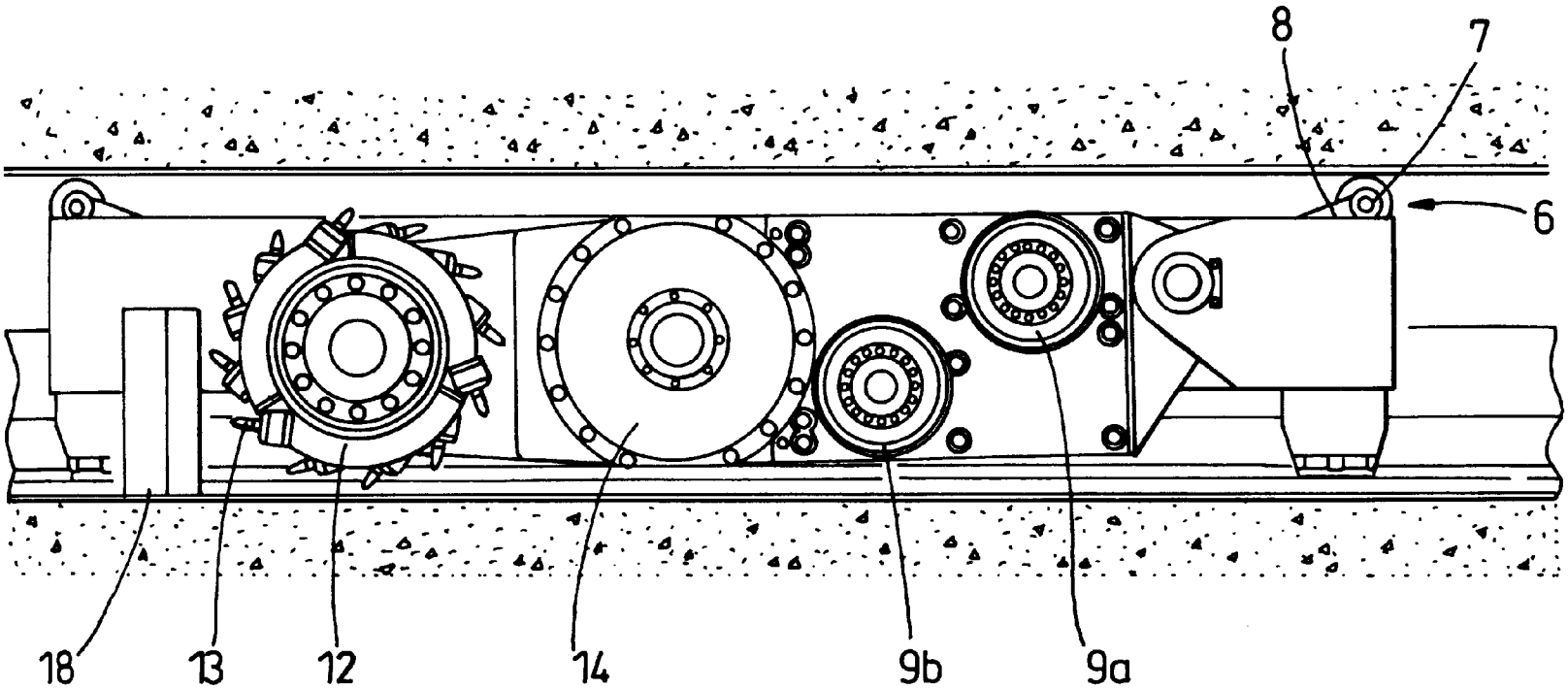
FIG. 2 is a side elevation view of the mining machine of FIG. 1.

Turning now to the figures there is described in FIGS. 1 and 2 a mining machine according to one aspect of the present invention. The machine comprises a housing 1 which incorporates the operative elements of the machine.

The housing is substantially rectangular in configuration comprising a top surface 2, bottom surface 3, two longitudinal side surfaces 4 and two end surfaces 5.

Stabilising means 6 are provided on the top surface 2 adjacent to the two end surfaces to stabilise the machine at the correct position adjacent the rock face to be cut. The stabilising 6 means may for example comprise a rotatable body 7 mounted on an adjustable arm 8 which allows the body to follow the contour of the roof of the mining area.

A arm 11 is provided on the longitudinal side surface 4 of the housing, behind the following cutting disc. The arm is hingedly connected to the side surface and can be raised or lowered adjacent the side surface of the housing.

A plurality of cutting discs 9 are mounted on one of the side surfaces of the arm 11. The discs preferably are of a type which cuts using an oscillating technique. The discs 9 are mounted in an off-set relationship, one behind the other.

In the embodiment shown, the leading disc 9a is mounted adjacent to the top surface 2 of the arm 11 and the following disc 9*b* is mounted adjacent to the bottom surface 3 of the arm 11. The diameter of the discs is such that the cutting area of the discs overlap in order to avoid leaving a portion of rock within the seam as the discs pass over the rock face. This enables the discs to remove material from a seam in a single pass along the rock face.

Each disc 9*a*, 9*b* is mounted in a known manner on a shaft 10 which is rotated by a motor 14 which is also located within the arm 11.

A cutting drum 12 is rotatably mounted on the free end of the arm 11, the cutting drum having a plurality of picks 13 provided on the outer surface thereon. The cutting drum 12 is rotated by the motor 14 mounted within the arm.

The mining machine forms part of a system which also comprises a conveyor means 15 for removing material from the rock face to a remote location for further processing. The conveyor means may for example be a chain conveyor which is provided adjacent to the housing and onto which material is directed from the apparatus. In the embodiment shown in the drawings, the conveyor means 15 is provided underneath the bottom surface 2 of the housing towards the longitudinal side 4 remote from the rock face.

In one embodiment, it is envisaged that the cutter drum 12 or the shaft 16 on which it is mounted may be provided with helical surface channels 17 to direct material falling thereon onto the conveyor. This arrangement is shown in FIG. 1.

As shown in FIG. 2 a loading door 18 is located adjacent and slightly behind the cutter drum 12 into which material from the rock face is fed and from which it passes to the conveyor means 15.

Figure 6:
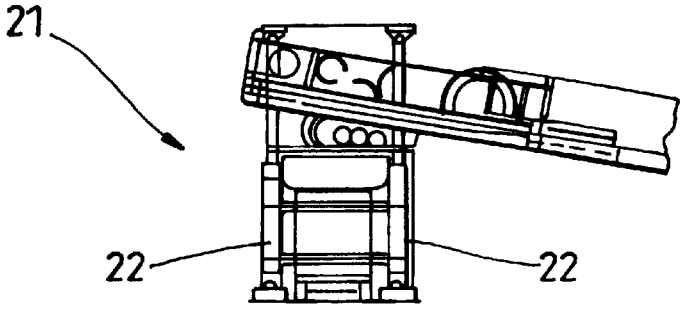
FIG. 6 is a detail view of one of the end support structures of the mining system of FIG. 5.
Figure 5:
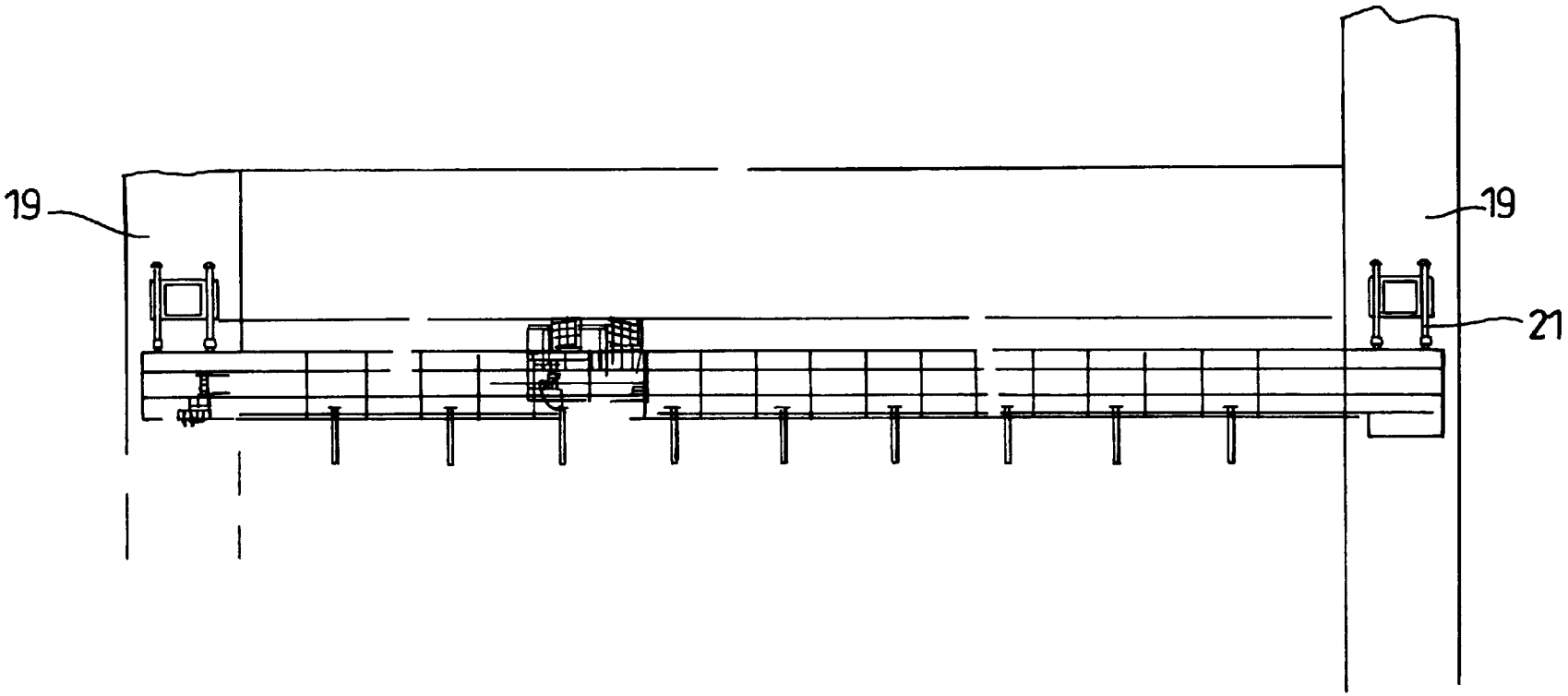
FIG. 5 is a schematic view of a mining system incorporating the mining machine of FIG. 1.

In order to locate the apparatus in the required area, two horizontal shafts 19 are driven at the opposite ends of the seam 20 in the rock face to be mined. This is shown in FIG. 5. Support means 21 are provided at either end of the seam, within the driven shafts. These are shown in FIG. 6 as a generally H-shaped structure comprising a plurality of hydraulic rams 22.

The vertical rams span the shaft between the roof and floor and act to provide a solid structure against which horizontal hydraulic rams on the support means can push in order to advance the mining machine at the end of each pass along the rock face.

The conveyor means 15 runs between the two support structures 21 at each end of the rock face and provides a track upon which the mining machine 1 can be run. Further conveyor means (not shown) are provided within at least one of the driven shafts 19 as will be described below.

Vertical support means 23 in the form of hydraulic devices are provided along the rock face to provide support between the floor and roof as will be described further below.

In operation of the apparatus, the housing 1 is placed over the conveyer means 15 which provides a track on which the housing is run. The longitudinal side surface 4 of the housing on which the cutting devices 9*a*, 9*b*, 12 are provided is placed against the rock face at one end of the seam. The motor is switched on and the cutter discs and cutter drum rotate accordingly.

As the housing 1 is traversed along the seam, the cutter discs 9*a*, 9*b* remove material from the centre of the seam, each cutting to the same depth within the seam. The cutter drum 12 the passes along the seam and trims the floor and roof of the seam to remove additional material which is not removed by the discs. This material is directed to the conveyer is and passes along the conveyor until it reaches the end which is located adjacent the support means 21. The material falls from the first conveyor onto a second conveyor which runs perpendicular to the first conveyor and is transported through one of the driven shafts 19 to a suitable point of recovery.

Figure 4:
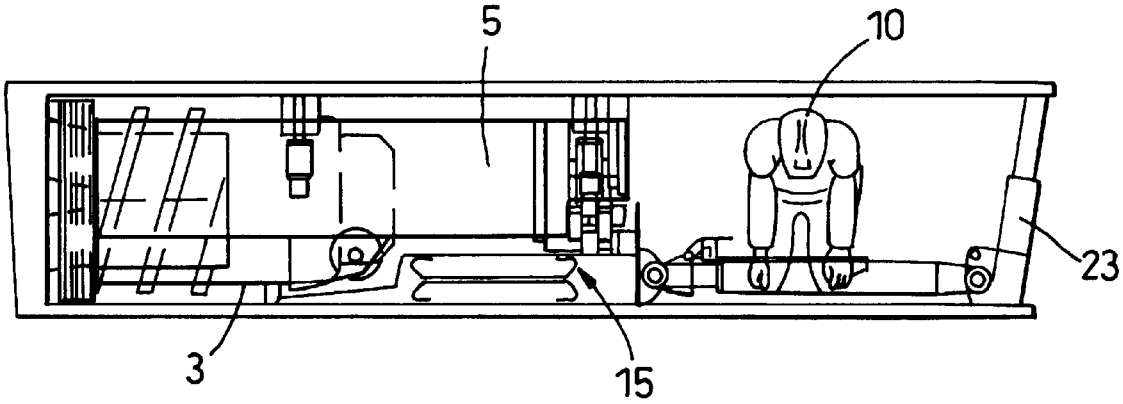
FIG. 4 is an end elevation of the mining machine of FIG. 1 showing an operator adjacent the machine.

As shown in FIG. 4 an operator 0 travels along with the machine 1, parallel to the rock face, in order to carry out required adjustments to the movement of the machine such as for example to operate the arm 11 to alter the position of the cutting drum 12 against the floor or roof of the channel cut in the seam by the cutting discs. This allows the drum 12 to better follow any deviations within the seam from vertical and allows for the removal of additional materials from the seam which would otherwise have to be removed by manual means.

When the end of the seam is reached, the machine 1 passes into one of the two support means 21 as shown in FIG. 6. The horizontal hydraulic rams are them activated in order that the housing 1 is then advanced towards the rock face such that the cutter discs 9*a*, 9*b* remain in contact with the face to enable a further pass in the opposite direction to be carried out. The hydraulic rams extend to push the housing 1 and the conveyor means 15 towards the rock face by the desired distance.

The apparatus and method of operation as described above allows recovery of materials to be achieved in a single effective pass along the rock face. Material is automatically recovered and loaded onto the conveyor means and thereby removed from the rock face.

It will be appreciated that the apparatus and method as described above provides a more cost effective manner in which to remove ore from a seam in an automated process and is especially useful in areas which the ore to be recovered is located in small seams in hard rock.

Furthermore, the method of operation of the machine is not labour intensive, indeed as shown, the machine can be operated by a sole operator within the cutting area. Therefore the dependence upon a substantial, healthy labour force is reduced considerably and allows the machine to be operated in remote locations to achieve cost efficient removal of the reef.

What is claimed is:

1.A mining machine for removing a reef of mineral from a rock face, the mining machine comprising a first cutting disc rotatably mounted on one side thereof, which disc is adapted to remove a portion of the rock face as the machine is traversed along the face; a second cutting disc rotatably mounted on the machine, at a position off-set from the first disc, and a cutting drum, said drum being mounted upon an arm which is vertically repositionable to allow the cutting drum to remove rock from the roof and floor of the trench formed by the action of the cutting discs.

2. A mining machine as claimed in claim 1, wherein at least one cutting disc is mounted on the arm and can be vertically repositioned.

3. A mining machine as claimed in claim 2, wherein the first and second cutting discs are rotated by a single motor.

4. A mining machine as claimed in claim 1, wherein the machine further comprises a conveyor for the purpose of carrying the machine, and a means for removing material from the rock face.

5. A mining machine as claimed in claim 4, wherein the means for removing material is a flexible conveyor.

6. A mining machine as claimed in claim 5, wherein the cutter drum comprises means to direct material cut from the face onto the conveyor means.

7. A mining machine as claimed in claim 1, wherein means are provided for advancing the mining machine towards the rock face at the end of each pass along the face.

8. A mining machine as claimed in claim 1, wherein the cutting discs are of a type which cut using an oscillating technique.

9. A mechanized method of removing mineral from a reef in a rock face using a mining machine as claimed in claim 1, which method comprises the steps of applying the cutting discs to the rock face to remove the center part of the reef to form a channel, and applying the cutting drum to the roof and floor of the channel which is cut into the mineral bearing reef to allow the machine to advance freely.

* * * * *